US006899266B2

(12) United States Patent
Conway

(10) Patent No.: US 6,899,266 B2
(45) Date of Patent: May 31, 2005

(54) STACKABLE PAPERBOARD CONTAINER

(75) Inventor: Doyle A. Conway, Modesto, CA (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 10/287,420

(22) Filed: Nov. 4, 2002

(65) Prior Publication Data

US 2004/0211824 A1 Oct. 28, 2004

Related U.S. Application Data

(60) Provisional application No. 60/336,486, filed on Nov. 2, 2001.

(51) Int. Cl.[7] ..... B65D 21/032

(52) U.S. Cl. ..... 229/169; 229/177; 229/178; 229/916; 229/918

(58) Field of Search ..... 229/169, 176, 229/177, 178, 191, 915, 916, 918, 919; 206/509

(56) References Cited

U.S. PATENT DOCUMENTS

| | | | | |
|---|---|---|---|---|
| 2,350,932 A | * | 6/1944 | Schaefer | 229/191 |
| 3,114,493 A | | 12/1963 | Dunkin | 229/34 |
| 3,899,121 A | | 8/1975 | Herbetko | 229/34 |
| 3,940,053 A | | 2/1976 | Putman et al. | 229/34 |
| 4,151,948 A | * | 5/1979 | de la Fuente, Jr. | 229/918 |
| 4,347,968 A | | 9/1982 | Cornell et al. | 229/33 |
| 4,356,952 A | * | 11/1982 | Rekow | 229/169 |
| 4,418,863 A | | 12/1983 | Kimbrell, Sr. | 229/49 |
| 4,546,913 A | | 10/1985 | Castillo | 229/33 |
| 4,770,339 A | | 9/1988 | Weimer | 229/143 |
| 4,883,221 A | | 11/1989 | Brundage | 229/143 |
| 4,884,739 A | | 12/1989 | Nederveld | 229/109 |
| 4,911,355 A | | 3/1990 | Bannister | 229/143 |
| 5,002,224 A | | 3/1991 | Muise | 229/169 |
| 5,458,283 A | | 10/1995 | Southwell et al. | 229/178 |
| 5,487,505 A | | 1/1996 | Nilsson | 229/191 |
| 5,535,941 A | | 7/1996 | Garza | 229/191 |
| 5,649,663 A | | 7/1997 | Pestow, Jr. | 229/190 |
| 5,673,848 A | | 10/1997 | Garza | 229/191 |
| 5,860,590 A | | 1/1999 | Blomfield et al. | 229/165 |
| 6,116,498 A | | 9/2000 | Sheffer | 229/114 |
| 6,158,652 A | | 12/2000 | Ruiz et al. | 229/178 |
| 6,604,675 B2 | * | 8/2003 | Southwell | 229/191 |

FOREIGN PATENT DOCUMENTS

| | | | | |
|---|---|---|---|---|
| EP | 444004 A1 | * | 8/1991 | 229/178 |
| FR | 2651482 A1 | * | 3/1991 | 229/919 |
| GB | 2 264 484 A | | 1/1993 | |
| GB | 2266705 A | * | 11/1993 | 229/178 |
| GB | 2 267 697 A | | 12/1993 | |

* cited by examiner

*Primary Examiner*—Gary E. Elkins
(74) *Attorney, Agent, or Firm*—Daniel C. Stelter

(57) ABSTRACT

A paperboard container folded from a single unitary blank of paperboard has a bottom wall, opposite side walls, and opposite end walls. Stacking tabs project from an upper edge of the side walls for receipt in corresponding slots in an edge of the bottom wall of an adjacent stacked container, and ventilation openings are formed in the side walls for circulation of air. The side walls are formed by inner and outer roll-over panels, and are slightly inwardly inclined to provide space for circulation of air between the containers when two of them are abutted together in side-by-side relationship. First extension flaps on the ends of the inner roll-over panels lie against and are secured to the inner surface of the end walls, and second extension flaps on the ends of the end walls extend between and are captured by the inner and outer roll-over panels. In a preferred embodiment, the first extension flaps and the roll-over panels are held in place by interengaged detent tabs and slots, while in another embodiment the first and second extension flaps are adhesively secured to adjacent panels.

21 Claims, 16 Drawing Sheets

STACKABLE PAPERBOARD CONTAINER

This application claims the benefit of U.S. provisional application Ser. No. 60/336,486, filed Nov. 2, 2001.

BACKGROUND OF THE INVENTION

1. Field of the Invention

The present invention relates to containers in general, and more specifically to stackable containers made of paperboard. In particular, the present invention relates to a ventilated stackable container having good structural rigidity and which uses less material in its construction than conventional containers.

2. Prior Art

Containers made of paperboard, i.e., corrugated cardboard, are commonly used in the produce industry to pack, store and ship fresh produce. These containers typically have a bottom, opposite side walls, opposite end walls, and an open or partially open top, and when filled with fresh produce are placed on a pallet for shipping and handling. A standard pallet as used in the industry has a width of 40 inches and a length of 48 inches, and the containers are sized so that a plurality of containers can be placed side-by-side on the pallet. A typical container, for example, may have exterior width and length dimensions of about 20 inches by 16 inches, whereby six containers can be placed side-by-side on the pallet. Additional containers are then stacked on top of one another to form multiple layers of containers until a predetermined number of the filled containers are supported in stacked relationship on the pallet.

The loaded pallets may then be transported to a refrigeration unit to cool and/or store the fresh produce. To insure that all of the produce is appropriately cooled, the ventilated containers are provided with ventilation openings in at least some of their side, end and/or bottom walls, and are designed so that cooling air can circulate around, through and between the containers stacked on the pallet.

To enable the containers to be stacked on top on one another in stable relationship, stacking tabs are typically provided on the top or bottom edges of at least some of the side and/or end walls, and openings or notches are provided in the opposite edge for receipt of an aligned stacking tab on an adjacent stacked container. In addition to providing a positive detent to prevent lateral shifting of the stacked containers relative to one another, the stacking tabs also serve to index the containers for proper stacked alignment.

Further, the loaded and stacked containers are subjected to considerable forces during shipment and handling, and must have sufficient structural strength and rigidity to withstand these forces. Thus, the side and/or end walls of the containers are usually constructed with multiple thicknesses, and/or additional reinforcing structure also may be provided, and the flutes of the corrugated material are typically arranged to extend vertically.

Moreover, the containers may be constructed for hand set-up or machine set-up. If intended for hand set-up, they should be easy for the operator to manipulate, and reliably secured in their erected form. In either event, they should be economical to make and use.

U.S. Pat. Nos. 5,485,283 and 5,860,590 are exemplary of prior art stackable containers. Both of them incorporate stacking tabs and at least one wall of double thickness. Additionally, they both have additional reinforcing structure in the corners for added stacking strength. U.S. Pat. No. 5,485,283 has ventilation openings through the side, end and bottom walls, and U.S. Pat. No. 5,869,590 has the opposite end walls inwardly inclined to permit circulation of air between containers arranged in side-by-side abutting relationship. The container in U.S. Pat. No. 5,458,283 utilizes multiple reversely folded panels, and thus consumes a substantial amount of material in its construction. The container in U.S. Pat. No. 5,860,590 requires adhesive to hold it in erected position.

There is need for a paperboard container that is stackable, structurally rigid, easy to set-up, reliably remains in set-up condition, and requires a minimum amount of material in its construction.

SUMMARY OF THE INVENTION

The container of the invention is stackable, structurally rigid, easy to set-up, reliably remains in set-up condition, and requires a minimum amount of material in its construction. In the particular embodiments disclosed herein, the side walls are of double wall construction, formed by inner and outer roll-over panels, and first flap extensions on opposite ends of the inner roll-over panels are folded inwardly and lie against the inner surface of the end walls. Second flap extensions on opposite ends of the end wall panels are folded inwardly and captured between the inner and outer roll-over panels. The first flap extensions are joined to the ends of the inner roll-over panel by a pair of spaced parallel folds, forming a diagonal panel in each corner of the container. These diagonal panels provide reinforcement and lend substantial stacking strength to the container. First tabs extend upwardly from the upper edge of the outer roll-over panels in spaced relationship along its length, and second tabs on the captured second flap extensions extend upwardly through the upper edge of the side walls and lie against the first tabs to form reinforced double thickness stacking tabs on the upper edge of the side walls. The walls incorporating the roll-over panels and stacking tabs are inwardly inclined from about 2° to about 4°, whereby when two containers are placed in side-by-side abutting relationship with one another, space is formed between the abutting walls for circulation of cooling air. Notches in the upper edges of the side and end walls, and in some embodiments openings in the field of the walls, provide ventilation for circulation of cooling air through the container and produce held therein.

In a first embodiment of the invention, the container is designed for hand set-up, and locking tabs project downwardly from the bottom edge of the inner roll-over panels and extend into notches formed at the fold joining the side wall to the bottom of the container to hold the roll-over panels in position, and thus hold the second flap extensions and their associated end wall panels in erected position. A locking tab also projects from one edge of each diagonal panel and extends into a slit formed in the adjacent end wall panel to hold the first flap extensions and associated diagonal reinforcing panels in position. No adhesive is required, and manual set-up is very easy to accomplish. A minimal amount of material is used in construction, and once set up the container reliably remains in set up condition.

In a second embodiment, the container is designed for machine set up, and the locking tabs on the bottom edge of the inner roll-over panels and on an edge of the diagonal panels are eliminated. Instead of using locking tabs to hold the panels in erected position, adhesive is used to secure the first and second extension flaps and their associated side and end wall panels in their respective set up positions.

In another embodiment, partial lid panels are foldably joined to an upper edge of each of the end wall panels, and each of these partial lid panels are folded inwardly to lie over adjacent upper edges of the side walls. The partial lid panels are held in their inwardly folded operative position by engagement of the inner edges thereof in notches formed in the confronting edge of the stacking tabs. These partial lid panels can be provided on either or both the hand set-up or machine versions of the invention, although as specifically shown and described herein, they are incorporated on a hand set-up version.

Containers made in accordance with the invention are very strong, having excellent structural rigidity and stacking strength, and use approximately 11% less material than conventional containers. They are simple in construction, and in the hand set-up version, easy to set up, and once set up reliably remain in set-up condition.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
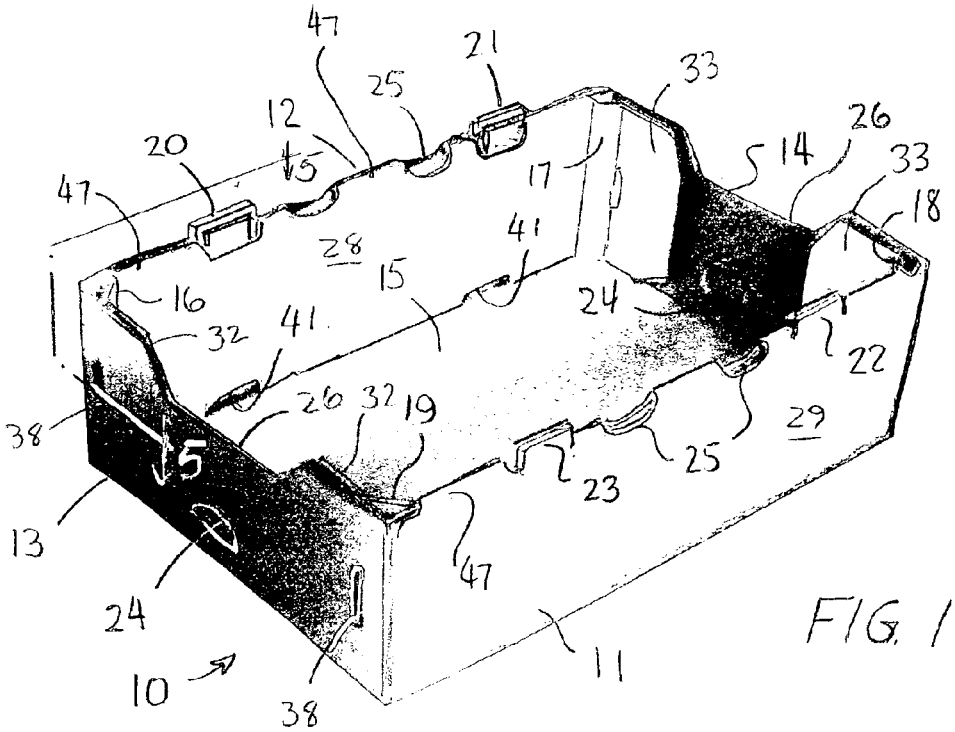
FIG. 1 is a top perspective view of a first and preferred embodiment of the invention, wherein the container is designed for hand set-up.
Figure 2:
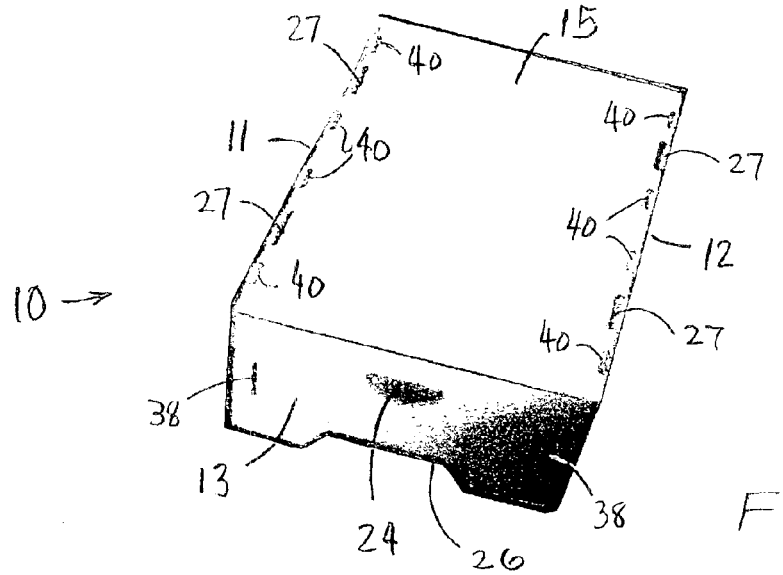
FIG. 2 is a bottom perspective view of the container of FIG. 1.
Figure 3:
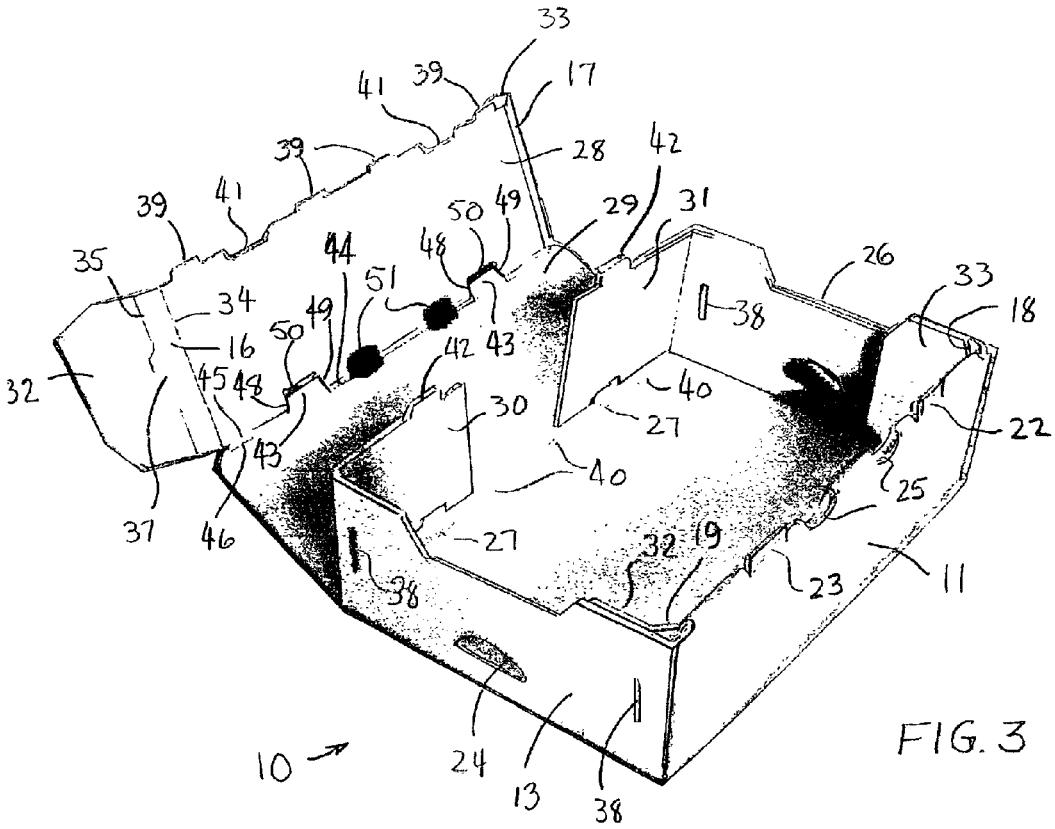
FIG. 3 is a top perspective view of the container of FIG. 1, shown in partially set-up condition.
Figure 4:
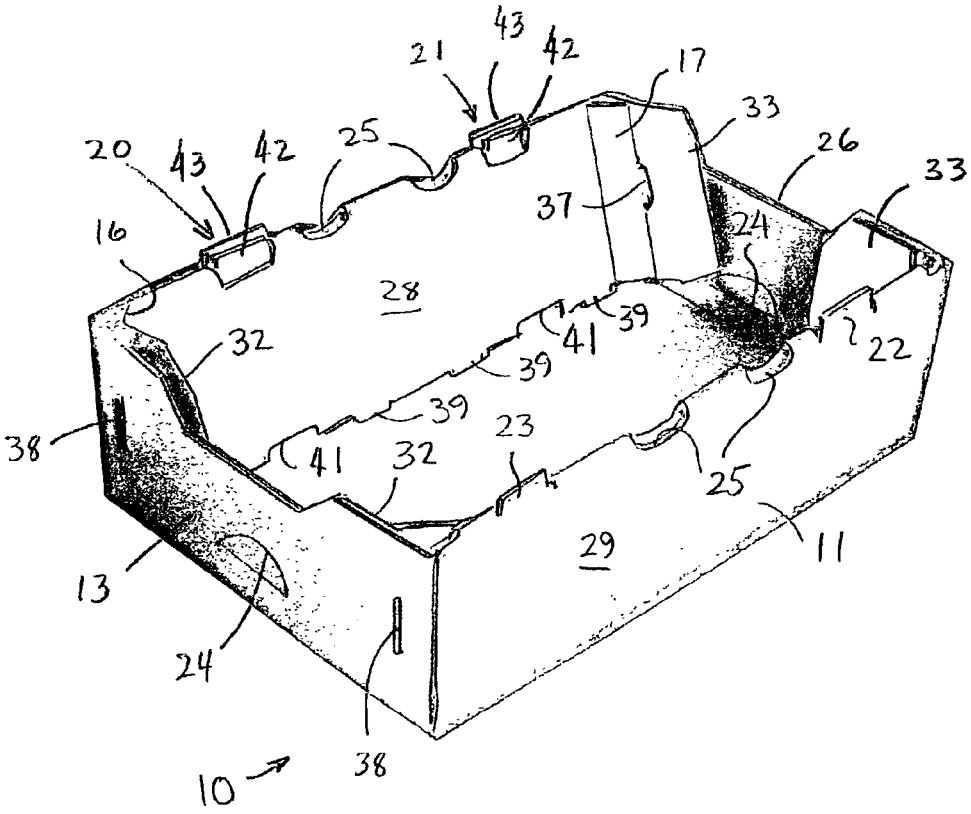
FIG. 4 is a top perspective view of the container of FIG. 1, shown in a further stage of set-up.
Figure 5:
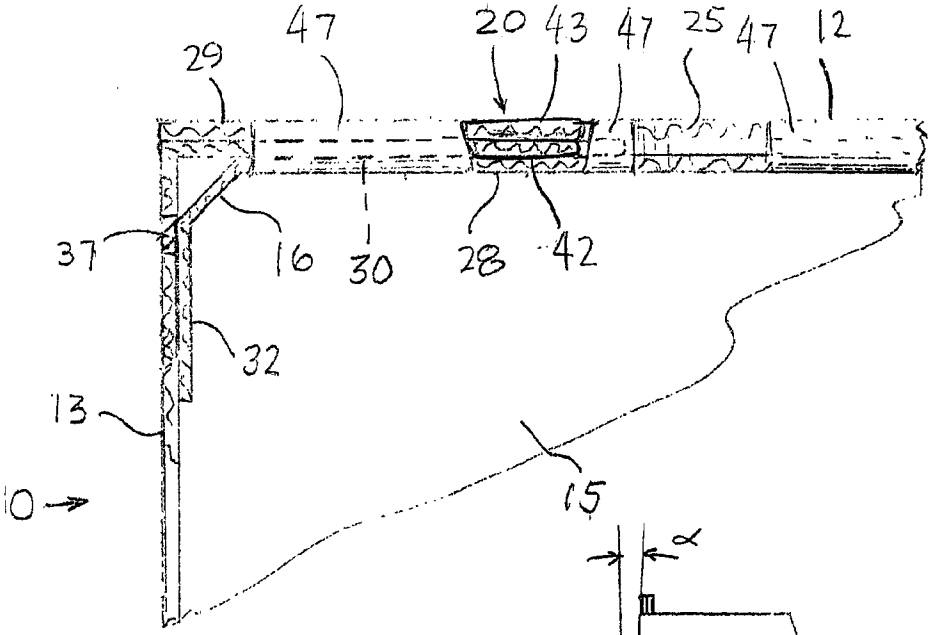
FIG. 5 is an enlarged, fragmentary, part sectional view of a corner portion of the container of FIG. 1, taken along line 5—5 in FIG. 1.

A first and preferred embodiment of the container of the invention is indicated generally at 10 in FIGS. 1–7. The container has opposite side walls 11 and 12, opposite end walls 13 and 14, a bottom wall 15, and reinforcing interior diagonal corner panels 16, 17, 18 and 19 for enhanced stacking strength and torsional rigidity. Double ply stacking tabs 20, 21, 22 and 23 are spaced along the top edge of the side walls, and combination hand hold and ventilation openings 24 are formed in the field of the opposite end walls. Recessed notches or cut-outs 25 and 26 in the top edges of the side walls and end walls, respectively, provide ventilation openings for circulation of air when the containers are stacked on top of one another, and openings 27 spaced around the edge of the bottom wall in alignment with the stacking tabs provide receptacles for the stacking tabs of a subjacent container when the containers are stacked. The stacking tabs serve to prevent lateral shifting of the stacked containers and also index the containers into stacked alignment with one another. The positioning of the openings 27 in the edge of the bottom wall and inside the plane of the respective side walls effectively encloses the stacking tabs when they are inserted into the openings.

The container 10 is simple in construction and uses a minimal amount of material, and yet has very good stacking strength and torsional rigidity. The side walls 11 and 12 are of triple wall thickness over most of their length, and comprise full length inner and outer roll-over panels 28 and 29, respectively, between which are sandwiched relatively long inwardly folded extension flaps 30 and 31 on opposite ends of the end walls 13 and 14, respectively.

The inner roll-over panels 28 each have extension flaps 32 and 33 on their opposite ends, traversed by pairs of relatively closely spaced parallel fold lines 34 and 35 positioned so that when the extension flaps 32 and 33 are folded inwardly alongside the inner surface of the respective end walls 13 and 14, the portion of the extension flaps between the parallel fold lines define the diagonal corner panels 16, 17, 18 and 19, which extend at about a 45° angle relative to the adjacent side and end walls.

A cut 36 is made in each extension flap 32 and 33 at the fold line 35, defining a tab 37 that projects from the fold line coplanar with the associated corner panel 16, 17, 18 or 19 when the extension flaps are folded into their operative set-up position, and these tabs 37 project into slots 38 formed in the adjacent end walls to hold the extension flaps 32 and 33 in their set-up positions alongside the inner surface of the respective end walls.

The roll-over panels are held in their inwardly folded set-up positions by engagement of a plurality of tabs 39 projecting from the bottom edge of the inner roll-over panel in slots 40 formed along the edge of the bottom wall 15. Cuts 41 are also formed in the bottom edge of inner roll-over panels 28 for registry with the stacking tab receiving slots 27 to prevent interference between the bottom edge of the inner roll-over panel and the stacking tabs when the stacking tabs are inserted into the slots 27.

The double ply stacking tabs 20–23 are formed by first tabs 42 projecting upwardly from the upper edge of the extension flaps 30 and 31 and second tabs 43 that project upwardly from the fold 44 between the inner and outer roll-over panels. The fold 44 is formed by closely spaced parallel fold lines 45 and 46 that define between them roll-over bands 47 that wrap over the upper edge of the side walls and present a smooth, finished appearance to the edges. The tabs 43 are formed by cuts 48 and 49 extending from the upper edge of outer roll-over panel 29 through and beyond the fold lines 45 and 46 and into the inner roll-over panel, where the cuts terminate in a slot 50 located so that the tab 42 can pass through the slot when the roll-over panels are folded into their operative set-up position. When the roll-over panels are in their operative set-up positions, the tabs 43 project upwardly as a continuation of the outer roll-over panel and coplanar therewith, and the tabs 42 on the extension flaps 30 and 31 lie against the inner surface of the tabs 43 and reinforce them.

Cut-outs 51 span the fold lines 45 and 46 and extend into the inner and outer roll-over panels to form the ventilation openings 25 when the roll-over panels are folded into their operative set-up positions.

Manual set-up of the container 10 is easily accomplished. The extension flaps 30 and 31 are folded inwardly, or upwardly with reference to the blank in FIG. 7, and the end walls 13 and 14 are folded to an upright position relative to the bottom 15. The roll-over panel 29 is then folded upwardly alongside the extension flaps 30 and 31, and the roll-over panel 28 is folded downwardly over the extension flaps until the tabs 39 on the bottom edge thereof engage in the slots 40. At this time, the extension flaps 32 and 33 lie alongside the inner surface of the end walls 13 and 14, and the tabs 37 are inserted into the slots 38.

Figure 6:
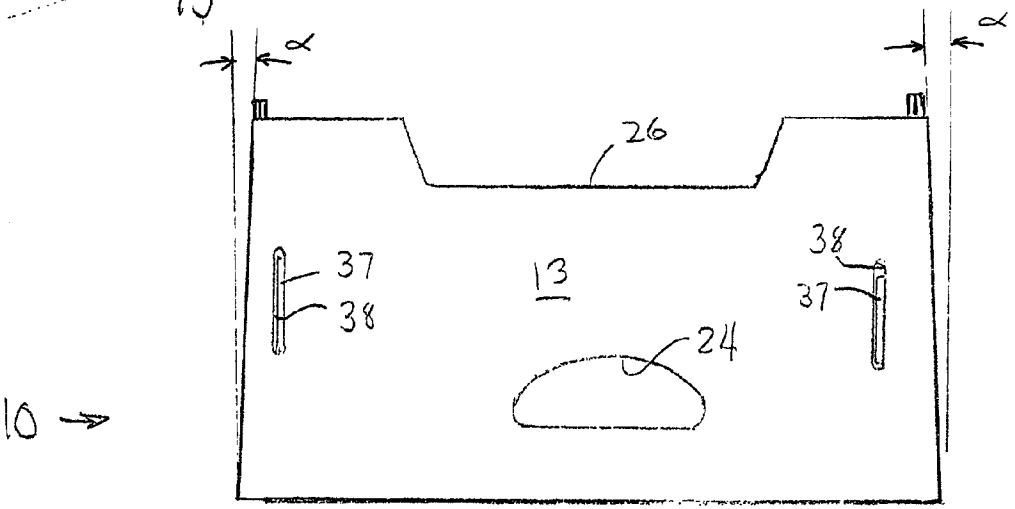
FIG. 6 is an end view in elevation of the container of FIG. 1.
Figure 7:
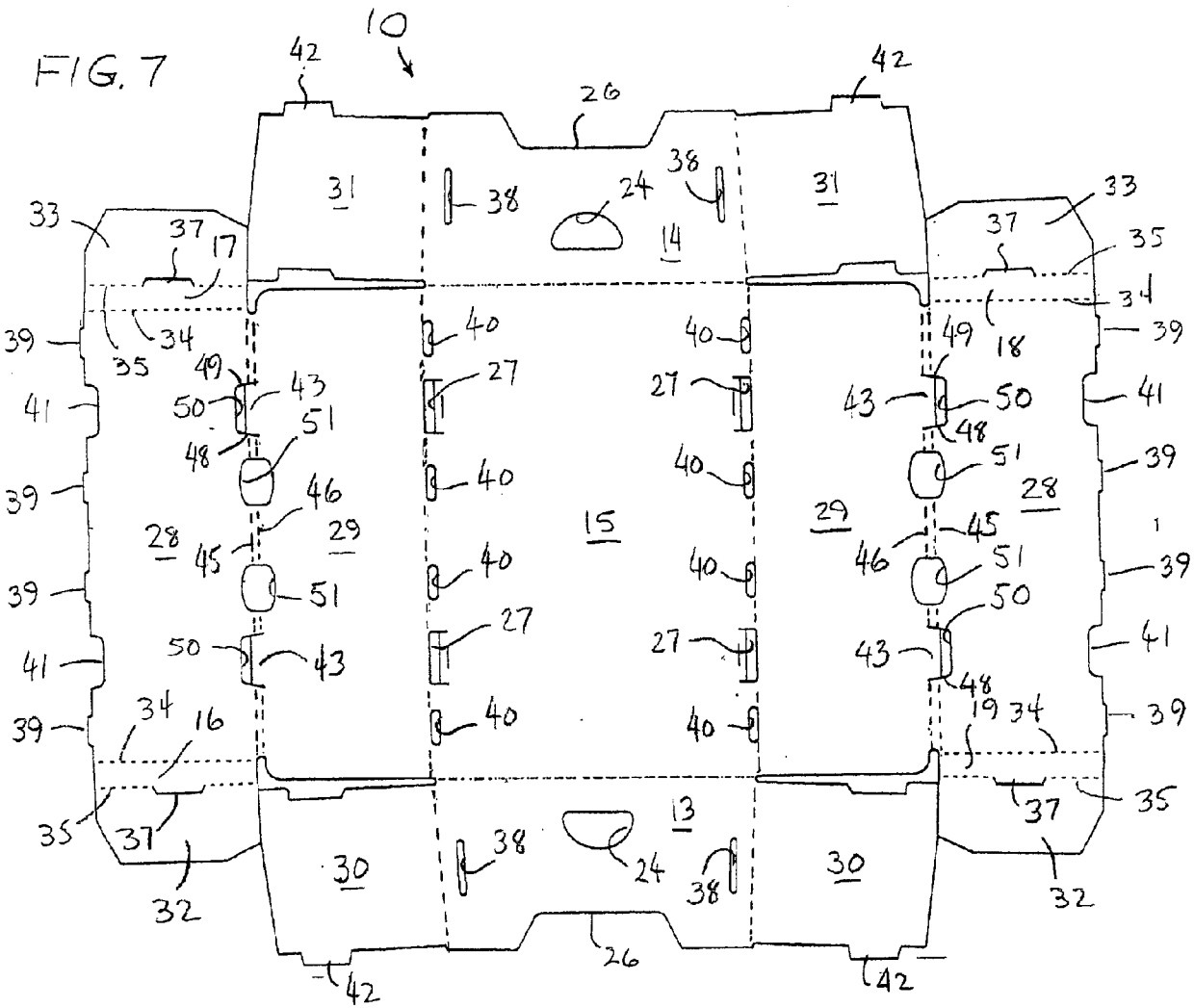
FIG. 7 is a plan view of the blank for making the container of FIG. 1.
Figure 8:
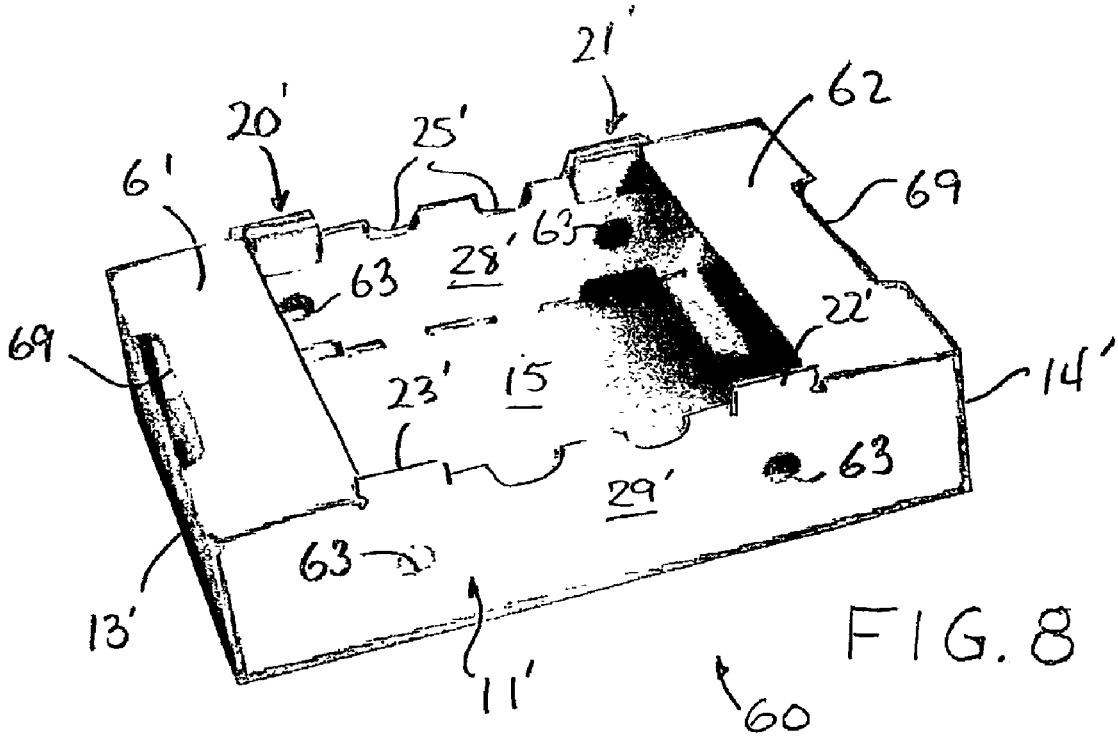
FIG. 8 is a top perspective view of a second embodiment of the container of the invention, wherein the container is designed for hand set-up and has a partial lid.
Figure 9:
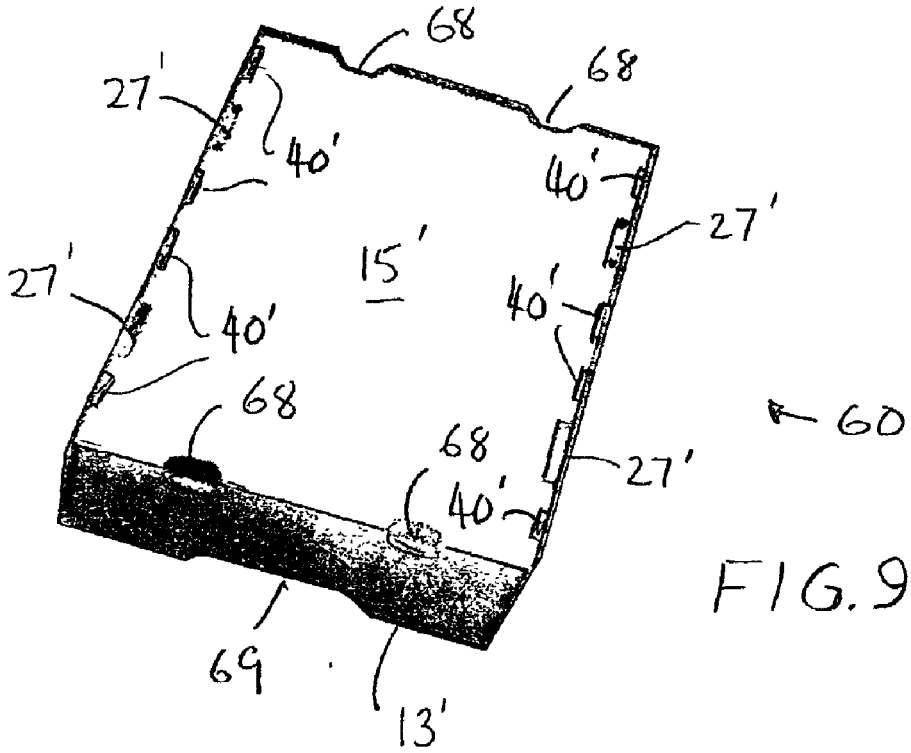
FIG. 9 is a bottom perspective view of the container of FIG. 8.
Figure 10:
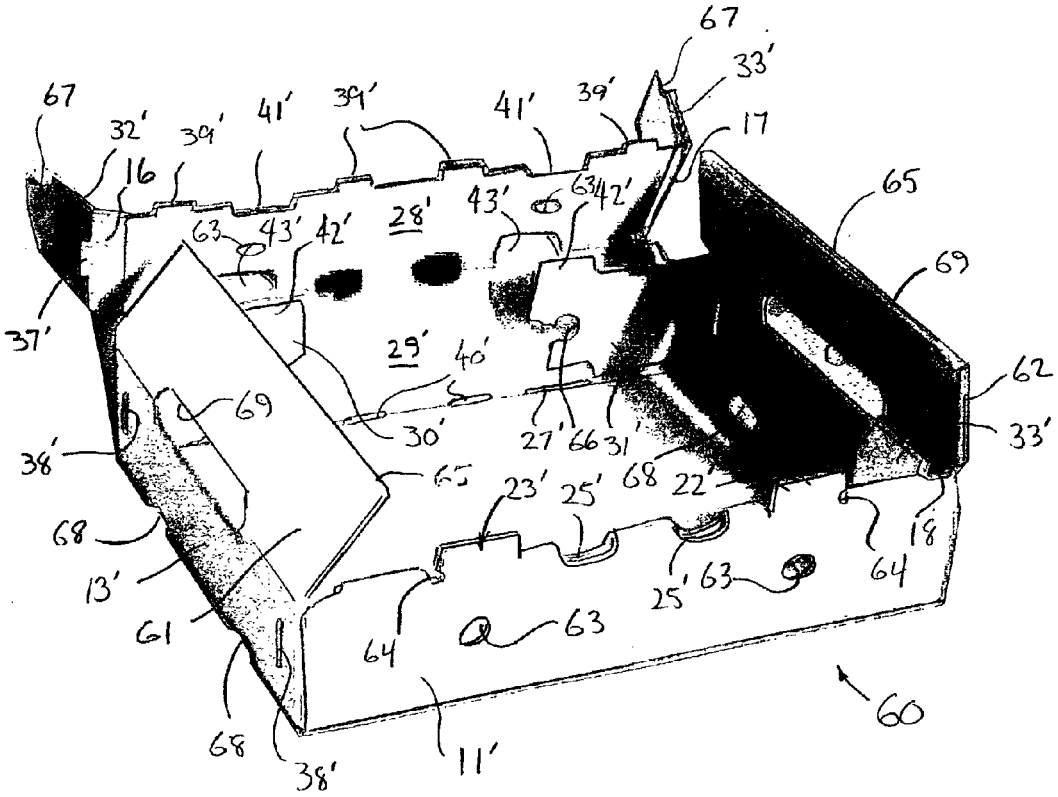
FIG. 10 is a top perspective view of the container of FIG. 8, shown in partially set up condition.
Figure 11:
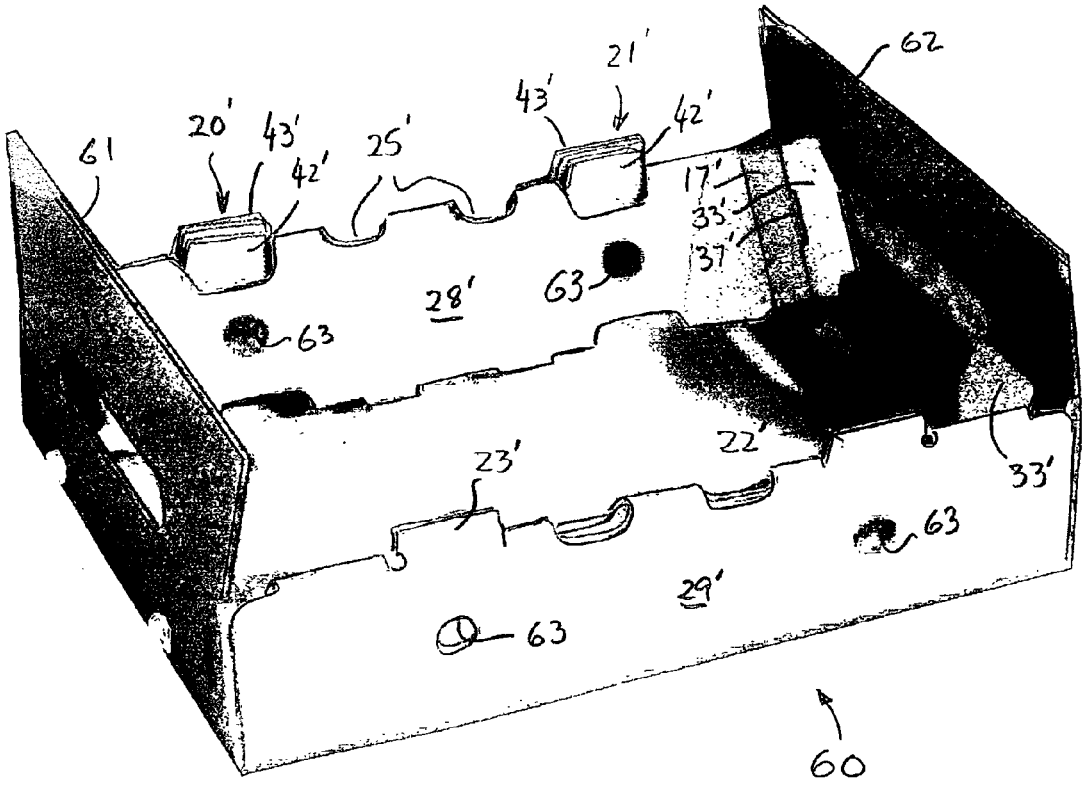
FIG. 11 is a top perspective view of the container of FIG. 8, shown in a further stage of set-up.
Figure 12:
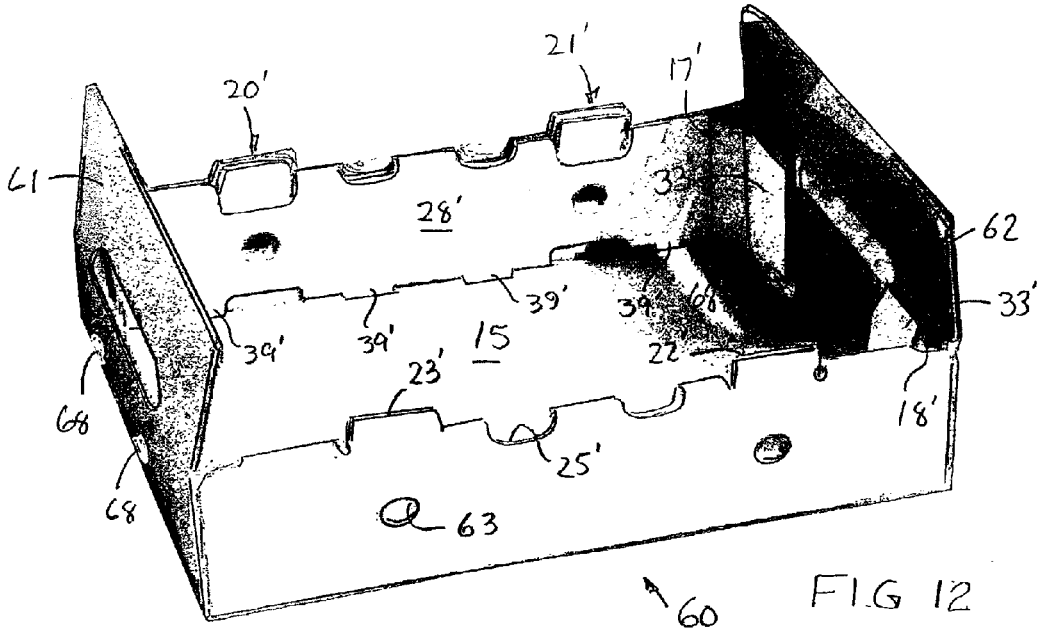
FIG. 12 is a top perspective view of the container of FIG. 8, shown in a still further stage of set-up, ready for the partial lids to be folded into latched position.
Figure 13:
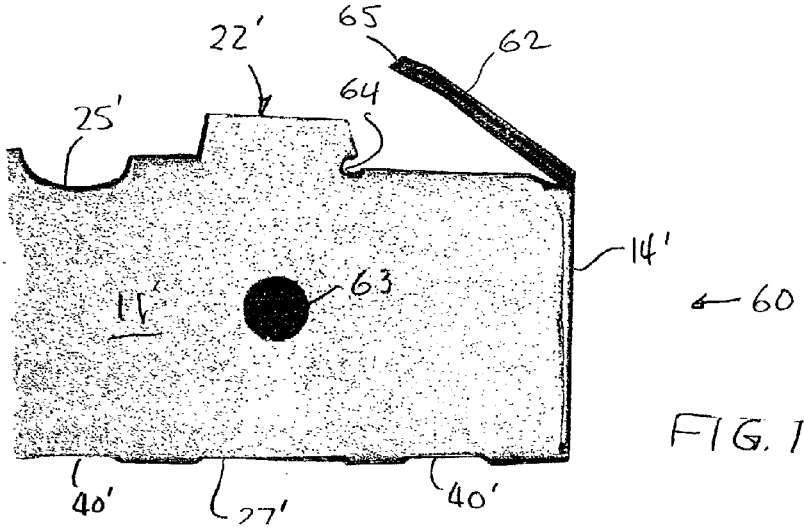
FIG. 13 is an enlarged fragmentary view in side elevation of a corner portion of the container of FIG. 8, showing details of the detent for retaining the partial lid in closed position.
Figure 14:
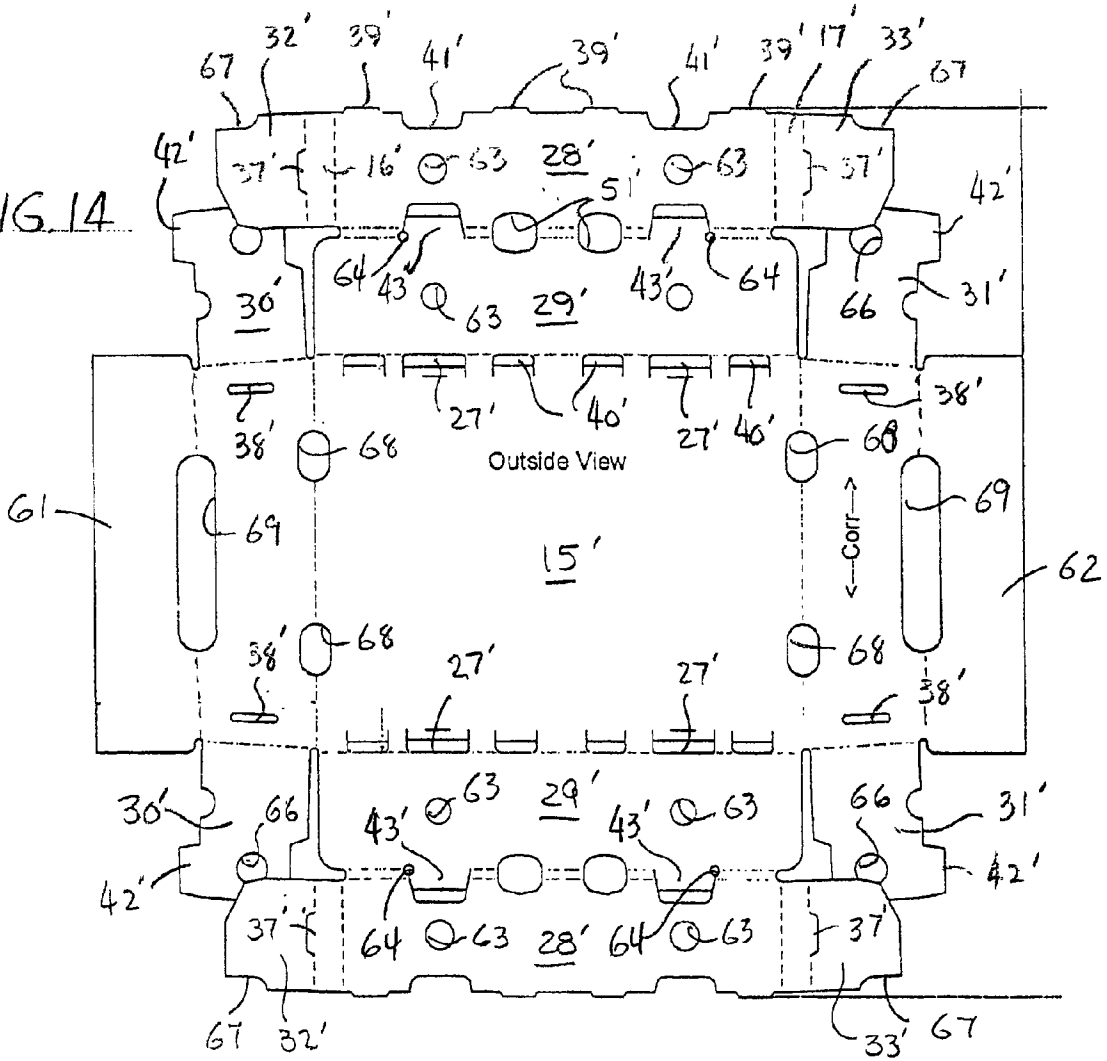
FIG. 14 is a top plan view of the blank for making the container of FIG. 8.
Figure 15:
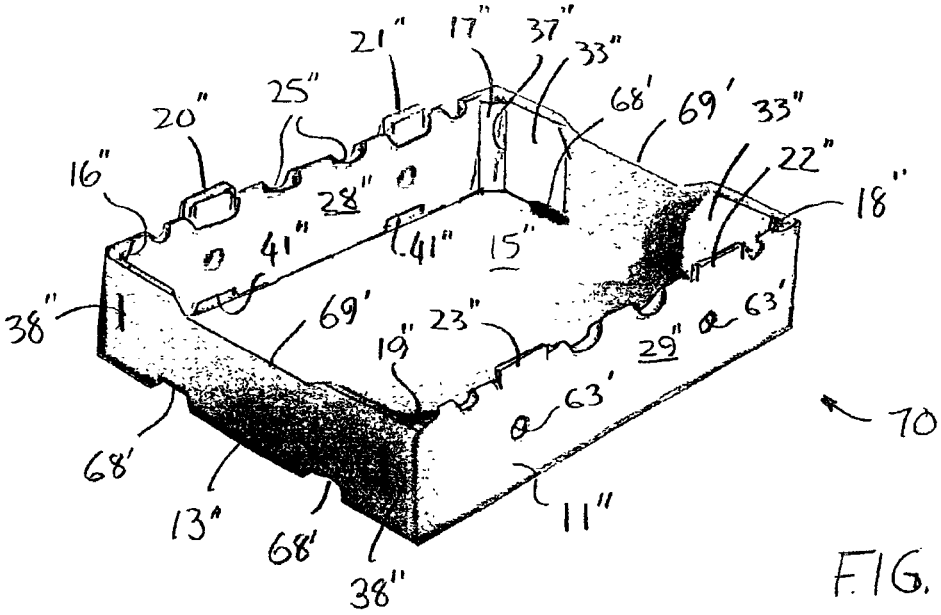
FIG. 15 is a top perspective view of a third embodiment of the container of the invention, designed for hand set-up, and modified relative to the FIG. 1 embodiment to form a different size container.
Figure 16:
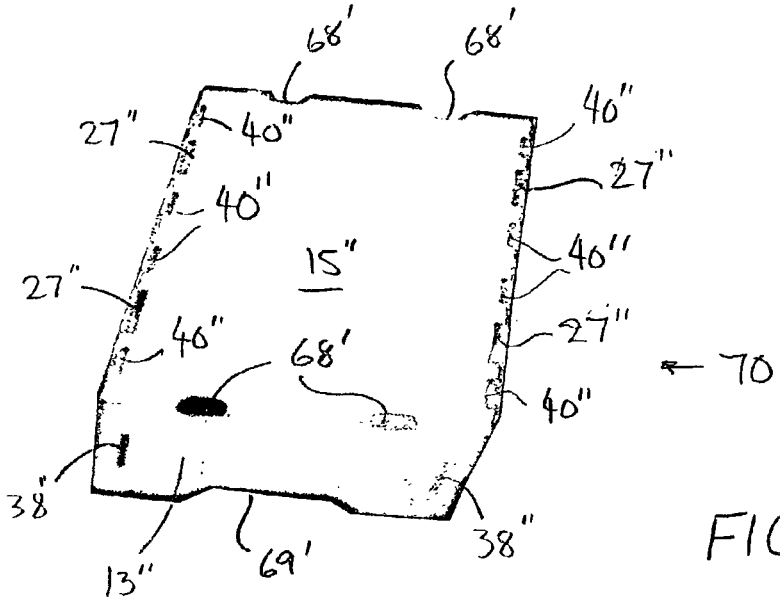
FIG. 16 is a bottom perspective view of the container of FIG. 15.
Figure 17:
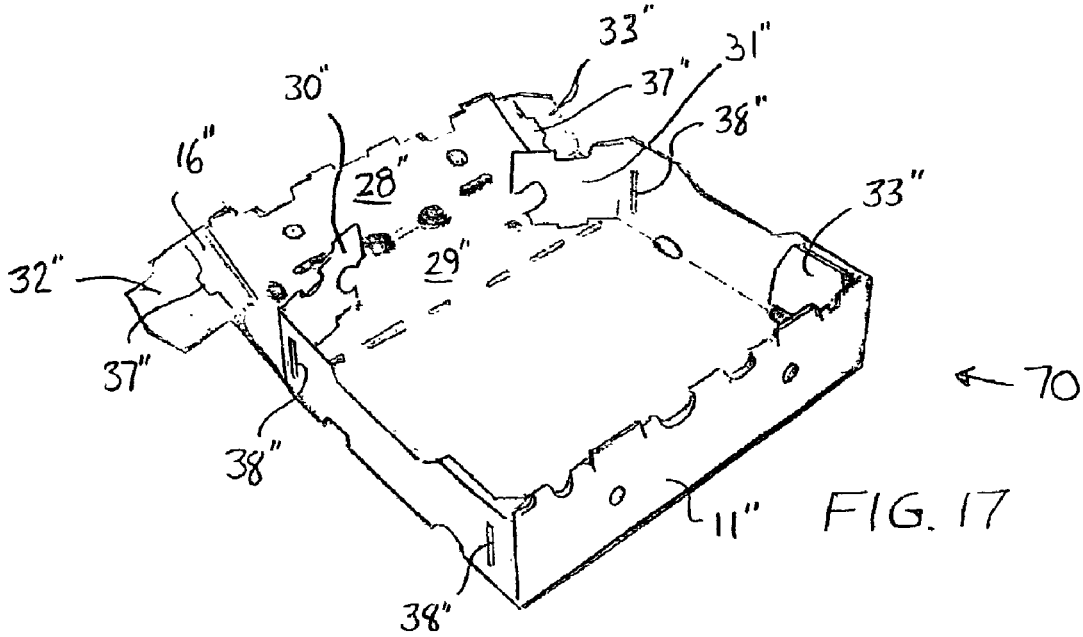
FIG. 17 is a top perspective view of the container of FIG. 15, shown in partially set-up condition.
Figure 18:
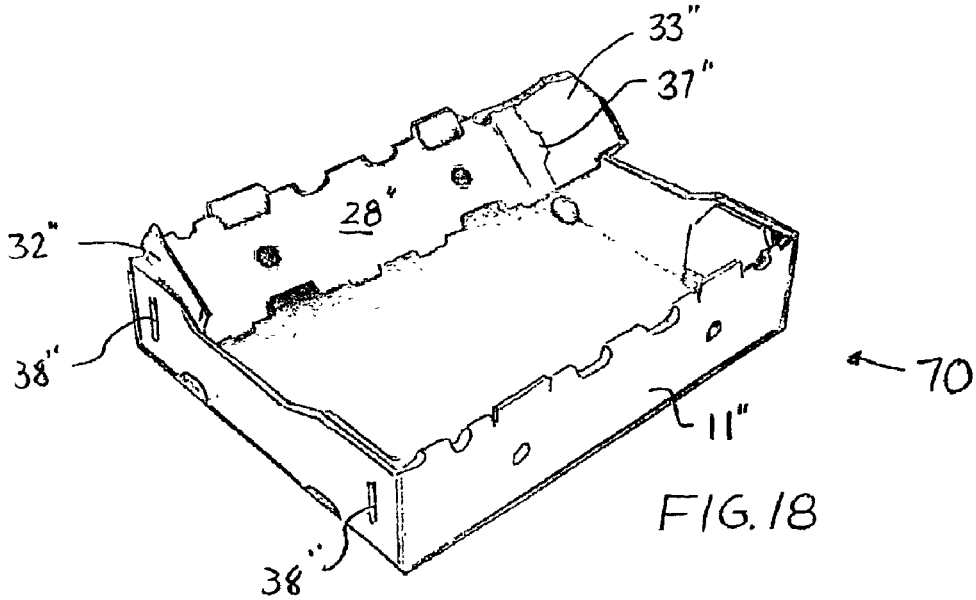
FIG. 18 is a top perspective view of the container of FIG. 15, shown in a still further stage of set-up.
Figure 19:
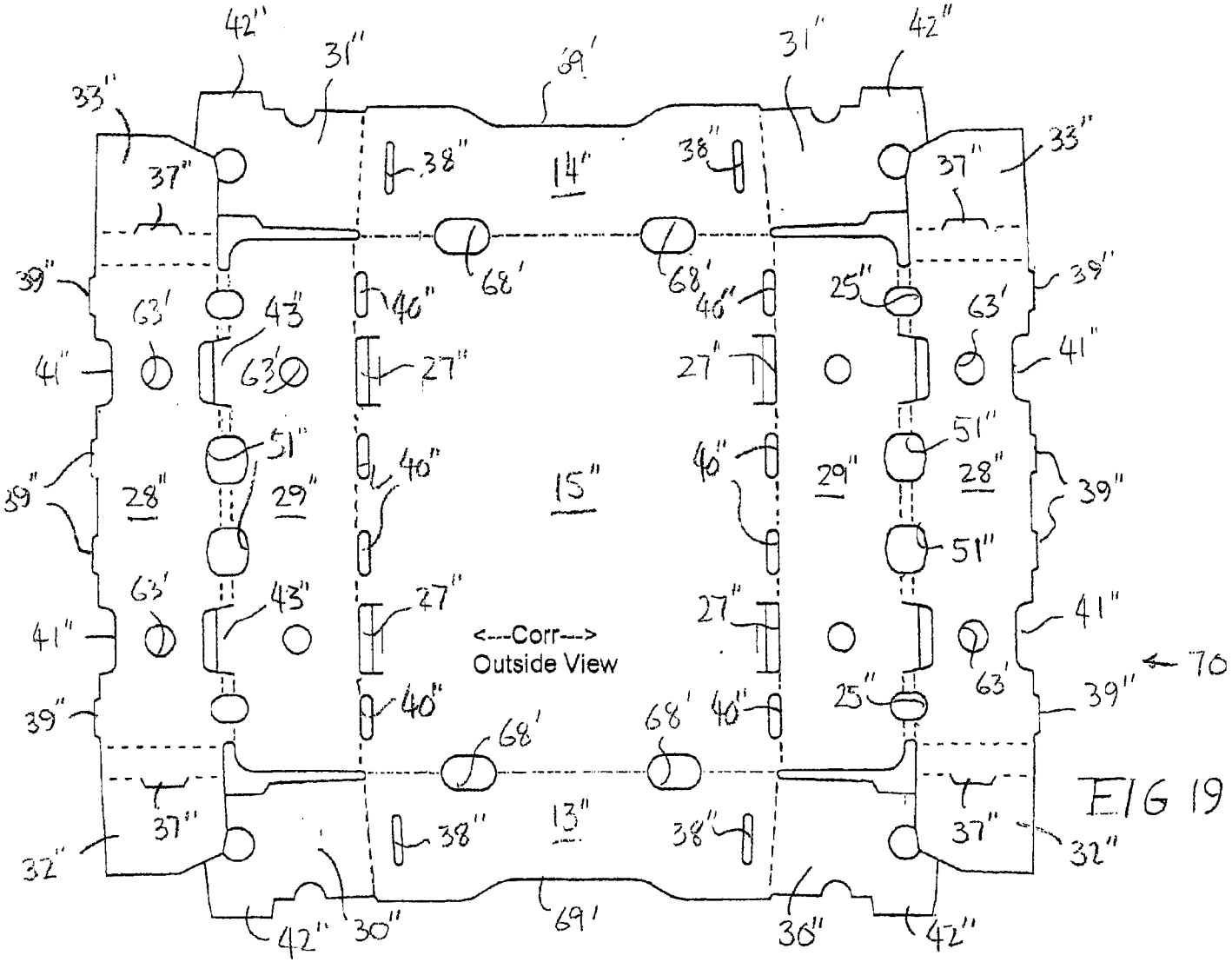
FIG. 19 is a top plan view of the blank for making the container of FIG. 15.
Figure 20:
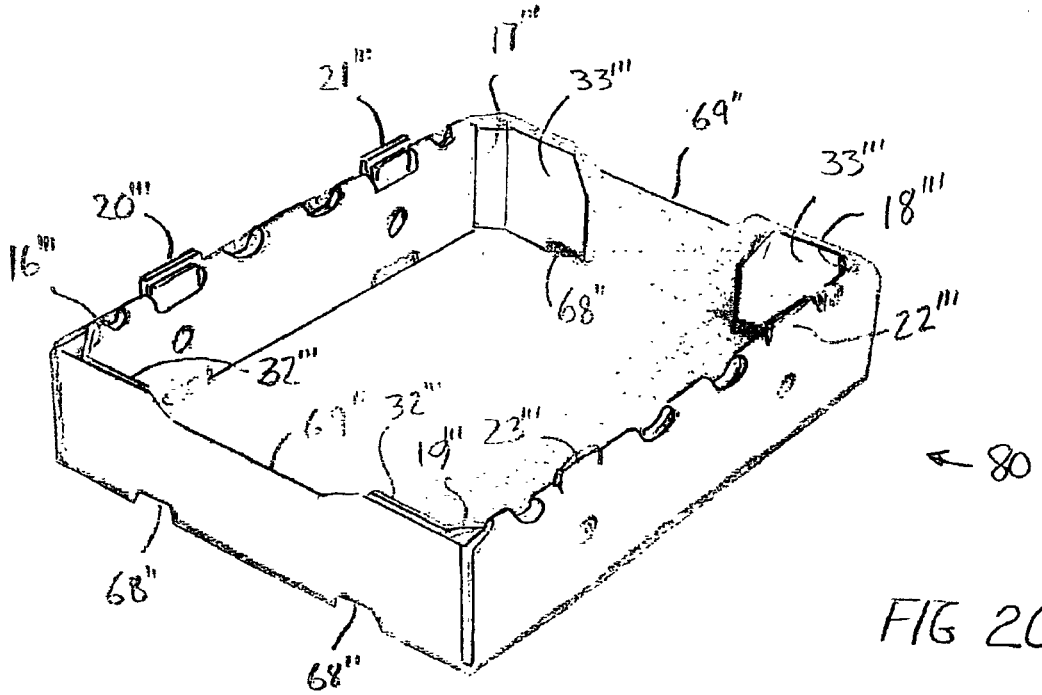
FIG. 20 is a top perspective view of a fourth embodiment of the container of the invention, designed for machine set-up.
Figure 21:
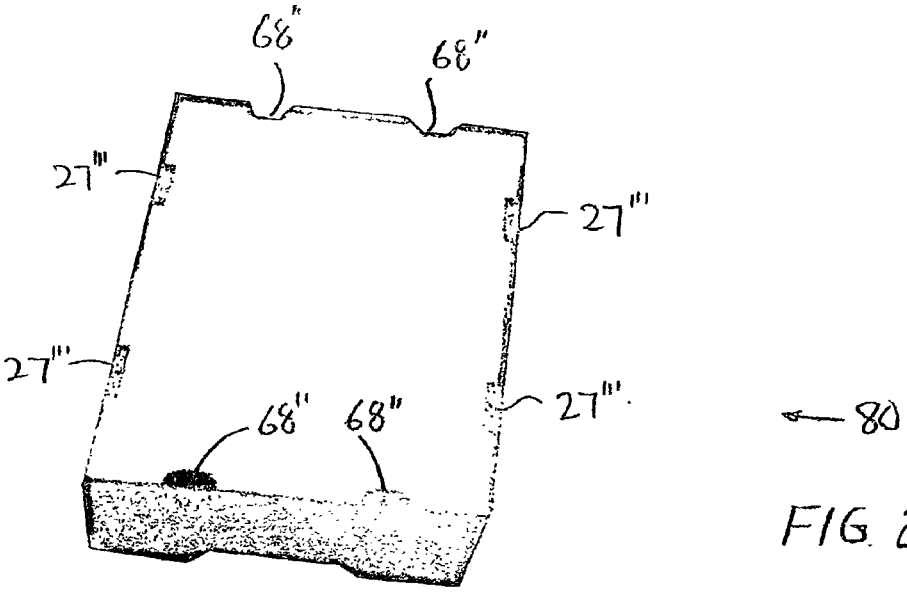
FIG. 21 is a bottom perspective view of the container of FIG. 20.
Figure 22:
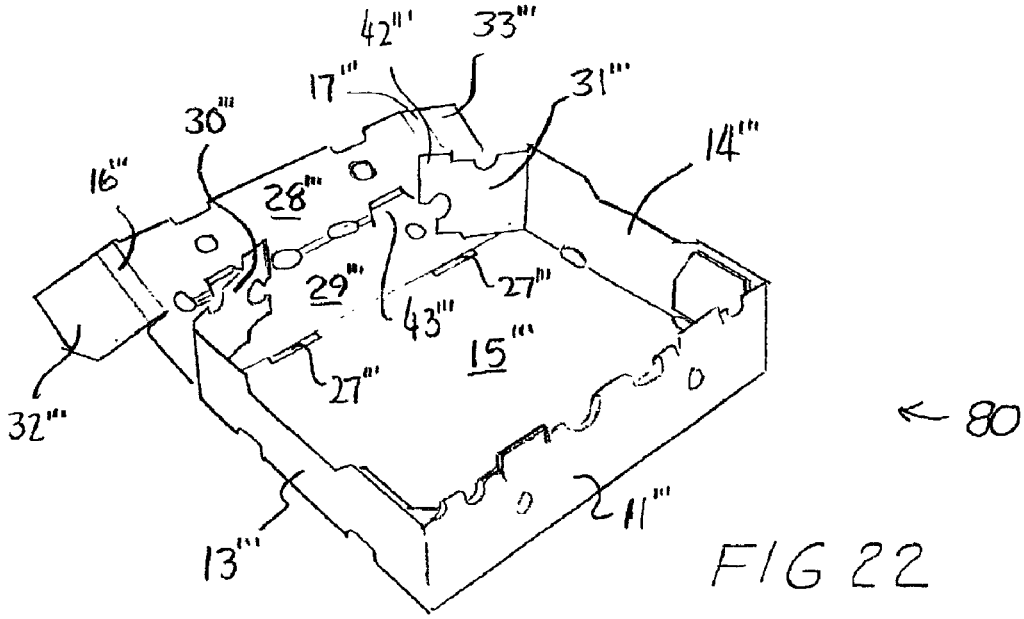
FIG. 22 is a top perspective view of the container of FIG. 20, shown in partially set-up condition.
Figure 23:
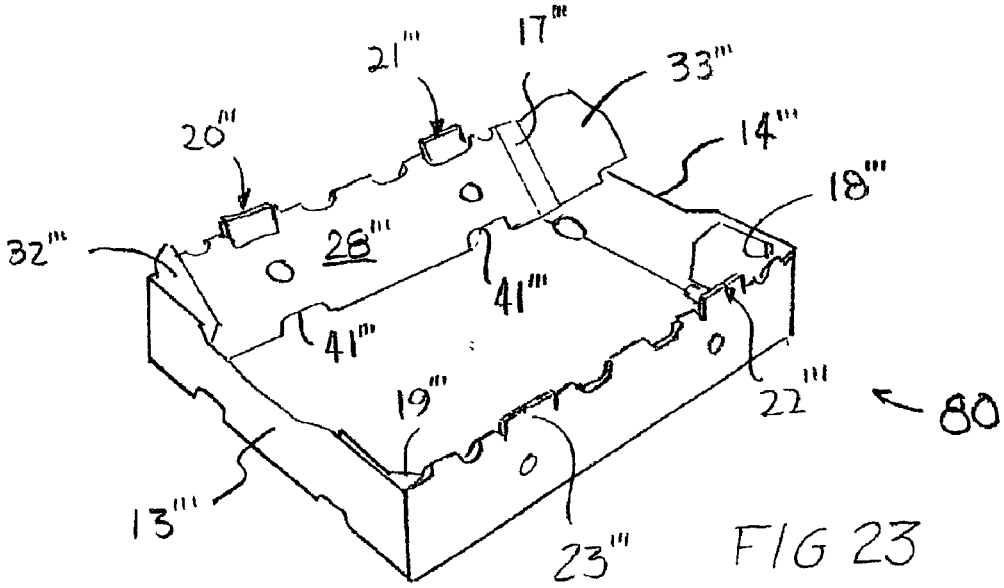
FIG. 23 is a top perspective view of the container of FIG. 20, shown in a still further stage of set-up.
Figure 24:
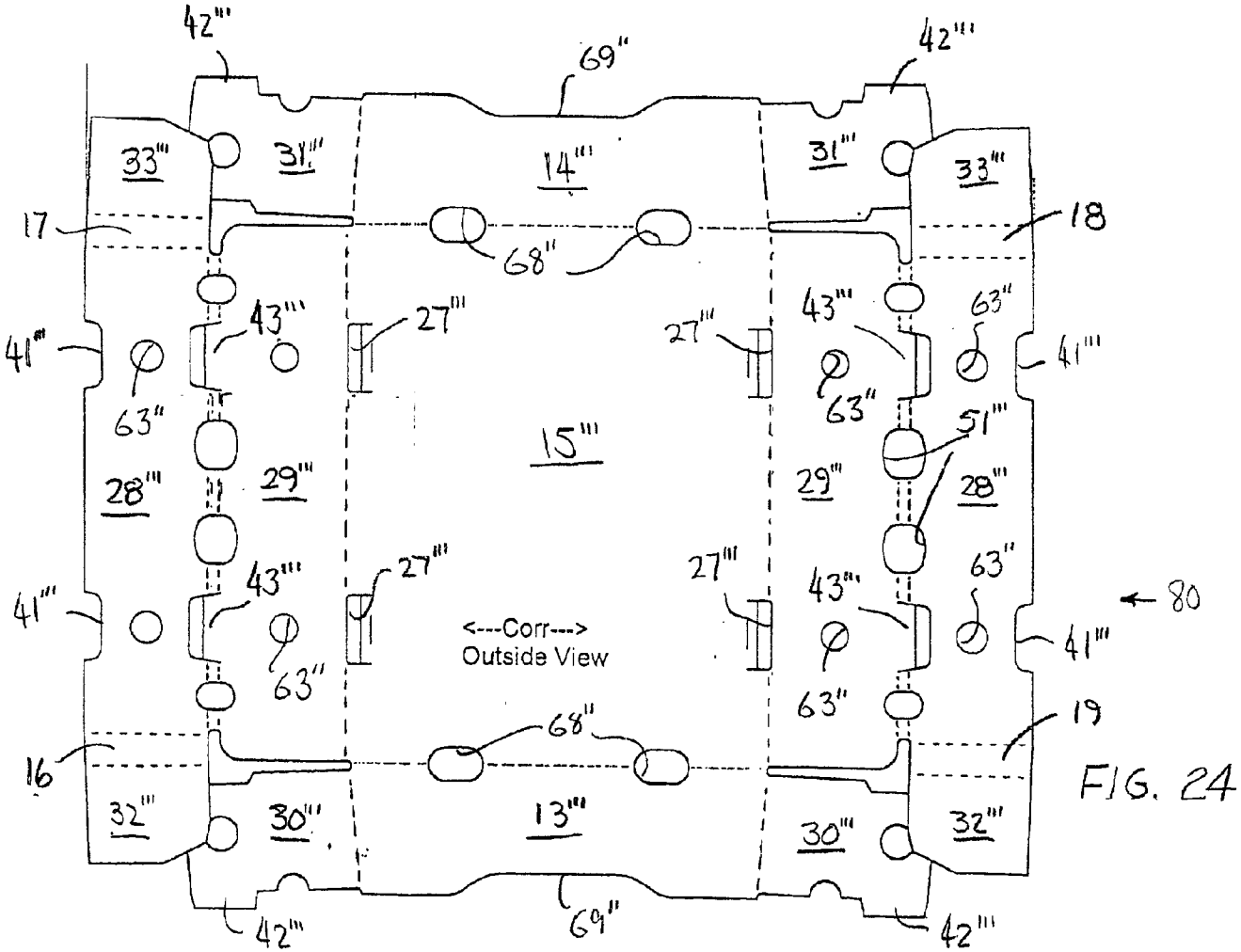
FIG. 24 is a top plan view of the blank for making the container of FIG. 20.

As indicated in FIG. 6, the walls carrying the stacking tabs, i.e., the indexing walls, in this case the side walls 11 and 12, are inwardly inclined an angle $\alpha$ of from about 2° to about 4° relative to the vertical. The end walls are essentially perpendicular to the bottom wall. This inward inclination of the indexing walls provides space between abutting walls of contiguous containers for circulation of cooling air.

The simple arrangement of panels, flaps and locking tabs, as described, requires less material than prior art containers of comparable structure and function, and the container thus formed is sturdy and reliably remains in erected position.

A second embodiment of the invention is indicated generally at 60 in FIGS. 8–14. This form of the invention is essentially the same as that previously described, including the inward inclination of the indexing walls, and like or similar components are identified with like reference characters primed. Therefore, a detailed description of all the components is not provided, since it is believed that the structure and function of the components of container 60 can readily be understood by reference to the drawings and comparison of the primed reference characters with those used in describing the previous embodiment.

The container 60 differs from that previously described primarily in that it has partial lids 61 and 62 that are folded inwardly over the opposite ends of the container. Further, ventilation openings 63 are formed through the side walls, and the container is a smaller size than the previous embodiment, i.e., it has less length, width and depth.

Additionally, the stacking tabs 20'–23' have notches 64 formed in their edges facing the adjacent ends of the container, and these notches cooperate with the end edges 65 of the inwardly folded partial lids to hold the lids in position. The extension flaps 30' and 31' have openings 66 formed therethrough for registry with the ventilation openings 63 formed through the inner and outer roll-over panels 28' and 29', and the extension flaps 32' and 33' are cut away at 67 at their inner bottom edges to register with ventilation openings 68 formed at the fold joining the end walls 13' and 14' with the bottom wall 15'.

Large ventilation openings 69 are also formed at the fold joining the lids 61 and 62 with the respective end walls. It will be noted that the ventilation openings 68 and 69 extend into both the bottom and end walls, and the lids and end walls, respectively, on opposite sides of the folds joining those parts.

In all other respects, the container 60 is constructed and functions essentially the same as the previously described embodiment.

A third embodiment of the invention is indicated generally at 70 in FIGS. 15–19. This form of the invention is virtually identical to that shown in FIGS. 8–14, except that the partial lids are omitted. Like elements are referred to by like reference characters primed or double primed, depending upon whether they were primed in FIGS. 8–14. A detailed description is not provided since it is believed that this embodiment can be clearly and easily understood by reference to the drawings and comparison of the double primed reference characters with the drawings and description of the previous embodiment.

A fourth embodiment of the invention is indicated generally at 80 in FIGS. 20–24. This form of the invention is essentially the same as that described in FIGS. 15–19, except that it is designed for machine set-up. All locking tabs are eliminated and the container is held in set-up condition by use of adhesives. Parts corresponding to those in the embodiment of FIGS. 15–19 are indicated by like reference characters double or triple primed, depending upon whether they were first primed in FIGS. 15–19.

In the container 80, the extension flaps 30''' and 31''' are glued between the roll-over panels 28''' and 29''', and the extension flaps 32''' and 33''' are glued to the inner surface of end walls 13''' and 14''', securely holding the container in set-up condition. All of the locking tabs on the inner roll-over panel 28''' and on the extension flaps 32''' and 33''', and their corresponding function, are omitted. In all other respects, this form of the invention is the same as that described in relation to FIGS. 15–19.

While particular embodiments of the invention have been illustrated and described in detail herein, it should be understood that various changes and modifications may be made to the invention without departing from the spirit and intent of the invention as defined by the scope of the appended claims.

What is claimed is:

1. A stackable container comprising:

a bottom wall, opposite end walls, and opposite side walls;

said end walls foldably joined to opposite ends of said bottom wall;

each of side walls comprising an outer roll-over panel and an inner roll-over panel, said outer roll-over panels foldably joined along a first edge thereof to a respective adjacent edge of the bottom wall, and said inner roll-over panels foldably joined along a first edge thereof to a second edge of said outer roll-over panel, said inner and outer roll-over panels, in their operative positions, being folded into closely adjacent, parallel, overlying relationship to one another so that the outer roll-over panel forms an outer side wall panel and the inner roll-over panel forms an inner side wall panel;

first securing means securing the inner and outer roll-over panels in their operative positions;

at least one of said inner roll-over panels having first extension flaps foldably joined to opposite ends of the inner roll-over panels, at least one of said first extension flaps being folded toward the opposite side wall to be positioned alongside one of the end walls;

second securing means securing each of the first extension flaps in position alongside its respective end walls; and at least one of said end walls having second extension flaps foldably joined to opposite ends of the end walls, at least one of said second extension flaps being positionable between the inner and outer roll-over panels.

2. A container as claimed in claim 1, wherein:

one or more stacking tabs are spaced along an upper edge of at least one of the side walls, and one or more openings are spaced along an upper edge of the bottom wall to register with the stacking tabs when one or more containers are stacked on top of one another, whereby the stacking tabs extend into the openings to positively retain the stacked containers in stable stacked relationship.

3. A container as claimed in claim 2, wherein:

at least one of the stacking tabs is of two ply construction, and includes a first tab projecting upwardly from an upper edge of the outer roll-over panel, and a reinforcing second tab projecting upwardly from an upper edge of the second extension flaps when said second extension flan is positioned between the inner and outer roll-over panels of its respective side wall, wherein said reinforcing second tab is positioned against said first tab when said second extension flap is positioned between said inner and outer roll-over panels of its respective side wall.

4. A container as claimed in claim 1, wherein:

at least one of said first extension flaps is joined to its respective inner roll-over panels by closely spaced parallel fold lines positioned so that when the first extension flap is folded to be positioned alongside the inner surface of its adjacent end wall, the fold lines define a diagonal corner panel.

5. A container as claimed in claim 1, wherein:

at least one of the side walls is inwardly inclined by about 2° to about 4° relative to the vertical to provide space for circulation of air when two or more containers are arranged in side-by-side relationship with one another.

6. A container as claimed in claim 1, wherein:

one or more ventilation openings are formed through at least one of said walls to provide for circulation of air through the container.

7. A container as claimed in claim 6, wherein:

the ventilation openings includes a recessed areas in an upper edge of the walls.

8. A container as claimed in claim 1, wherein:

a lid panel is foldably joined to an upper edge of at least one end wall, and said lid panels is folded inwardly over at least an adjacent end of the container to form at least a partial lid.

9. A container as claimed in claim 2, wherein:

a lid panel is foldably joined to an upper edge of at least one end wall, said lid panels being folded inwardly over at least an adjacent end of the container to form at least a partial lid; and a free inner edge of said lid panel is adapted to frictionally engage an adjacent edge of at least one of said stacking tabs bold the partial lid panels in closed position.

10. A container as claimed in claim 9, wherein:

at least one at the stacking tabs is of two ply construction, and includes a first tab projecting upwardly from an upper edge of the outer roll-over panel, and a reinforcing second tab projecting upwardly from an upper edge of the second extension flaps when said second extension flan is positioned between the inner and outer roll-over panels of its respective sidewall, wherein said reinforcing second tab is positioned against said first tab, said first tab having a greater width than said second tab; and wherein a notch is formed in an edge of said first tab immediately adjacent an upper edge of the side wall to provide a positive detent holding said partial lid in closed position.

11. A container as claimed in claim 1, wherein:

said first and second securing means comprise at least one interengaged detent tabs and slots to latch the inner rail-over panel of at least one side wall and the first extension flaps of said inner roll-over panel in operative position, said interengaged detent tabs and slots enabling said container to be set-up by hand without requiring the use of adhesives.

12. A container as claimed in claim 11, wherein:

said at least one detent tab includes a plurality of spaced apart first detent tabs projecting from a lower edge of the inner roll-over panel of at least one side wall for cooperation with aligned slots formed in an edge portion of the bottom wall, and a second detent tab projecting from each said first extension flap of said inner roll-over panel toward the adjacent end wall for cooperation with a slot formed in the end wall.

13. A container as claimed in claim 12, wherein:

at least one of said first extension flaps is joined to its respective inner roll-over panels by closely spaced parallel fold lines positioned so that when the first extension flap is folded to lie against the inner surface of the its respective end wall, the closely spaced parallel fold lines define a diagonal corner panel; and wherein said second detent tab projecting from the first extension flap is formed by cuts made in the first extension flap so that said second detent tab extends parallel to the plane of the diagonal corner panel and toward the end wall, and projects beyond the first extension flap and into the slot in the end wall.

14. A container as claimed in claim 1, wherein:

said first and second securing means comprises adhesive, said first extension flaps being adhesively secured to the inner surface of its respective end walls, and the second extension flaps being adhesively secured between the inner and outer roll-over panels.

15. A container as claimed in claim 1, wherein:

one or more stacking tabs are spaced an upper edge of at least one of the side walls, and one or more openings are spaced along an edge of the bottom wall to register with the stacking tabs when the one or more containers are stacked on top of one another, whereby the stacking tabs extend into the openings to positively retain the stacked containers in stable stacked relationship, at least one of said stacking tabs is of two ply construction, and includes a first tab projecting upwardly from an upper edge of the outer roll-over panel, and a reinforcing second tab projecting upwardly from an upper edge of the second extension flaps when said second extension flap is positioned between the inner and outer roll-over panels of its respective side wall, wherein said reinforcing second tab is positioned against said first tab when said second extension flap is positioned between said inner and outer roll-over panels of its respective side wall;

at least one of said first extension flaps is joined to its respective inner roll-over panels by closely spaced parallel fold lines positioned so that when the first extension flap is folded to be positioned alongside the inner surface of its adjacent end wall the fold lines define a diagonal corner panel;

at least one of the side walls is inwardly inclined by about 2° to about 4° relative to the vertical to provide space for circulation of air when two or more containers are arranged in side-by-side abutting relationship with one another; and one or more ventilation openings are formed through at least one of said walls to provide for circulation of air through the container.

16. A container as claimed in claim 15, wherein:

a lid panel is foldably joined to an upper edge of at least one end wall, said lid panels is folded inwardly over at least an adjacent end of the container to form at least a partial lid; and a free inner edge of said lid panel is adapted to frictionally engage an adjacent edge of at least one of said stacking tabs to hold the partial lid panels in closed position.

17. A container as claimed in claim 16, wherein:

said first tab has a greater width than said second tab; and wherein a notch is formed in an edge of said first tab immediately adjacent an upper edge of the side wall to provide a positive detent for engaging and holding a free edge of said partial lid panel.

18. A container as claimed in claim 17, wherein:

said first and second securing means comprise at least one interengaged detent tabs and slot to latch the inner roll-over panel of at least one side wall and the first extension flaps of said inner roll-over panel in operative position, said interengaged detent tabs and slot; enabling said container to be set-up by hand without requiring the use of adhesives.

19. A container as claimed in claim 18, wherein:

said at least one detent tabs includes a plurality of spaced apart first detent tabs projecting from a lower edge of the inner roll-over panel of at least one side wall for cooperation with aligned slots formed in an edge portion of the bottom wall, and a second detent tab projecting from each said first extension flap of said inner roll-over panel toward the adjacent end wall for cooperation with a slot formed in the end wall, said second detent tab being by cuts made in the first extension flap so that said second detent tab extends parallel to the plane of the diagonal corner panel and toward the end wall, and projects beyond the first extension flap and into the slot in the end wall.

20. A container as claimed in claim 15, wherein:

said first and second securing means comprises adhesive, said first extension flap being adhesively secured to the inner surface of its respective end wall, and the second extension flaps being adhesively secured between the inner and outer roll-over panels.

21. A paperboard blank for making a container having a bottom wall, opposite side wails, and opposite end walls, comprising:

a rectangular center panel having opposite side edges and opposite end edges, and which forms the bottom panel in a container;

a plurality of slots formed along the opposite side edges of the center panel;

an inner roll-over panel foldably joined to each of said side edges of said center panel, and an outer roll-over panel foldably joined to the inner roll-over panel, said inner and outer roll-over panels forming inner and outer side wall panels in a container made from said blank;

an end wall panel foldably joined to each of the opposite end edges of the center bottom panel; and first extension flaps foldably joined to opposite ends of each of said inner roll-over panels, and second extension flaps foldably joined to opposite ends of each of said end wall panels, said first extension flaps adapted to be secured to an inner surface of the end wall panels in a container made from the blank, and said second extension flaps adapted to be captured between the inner and outer roll-over panels in a container made from the blank.

* * * * *